United States Patent [19]

Walzer

[11] 4,141,258

[45] Feb. 27, 1979

[54] CONTROL MODULE WITH OVERRIDE MECHANISM

[75] Inventor: James L. Walzer, Plano, Ill.

[73] Assignee: Caterpillar Tractor Co., Peoria, Ill.

[21] Appl. No.: 783,103

[22] Filed: Mar. 31, 1977

[51] Int. Cl.[2] ..... G05G 5/06

[52] U.S. Cl. ..... 74/540; 74/529

[58] Field of Search ..... 74/540, 541, 529, 527, 74/475

[56] References Cited

U.S. PATENT DOCUMENTS

| | | | |
|---|---|---|---|
| 1,623,115 | 4/1927 | Hensley | 74/540 X |
| 1,654,321 | 12/1927 | Collins | 74/540 X |
| 1,823,695 | 9/1931 | Moorhouse | 74/540 |
| 2,119,638 | 6/1938 | Klampferer | 74/540 |
| 2,694,945 | 11/1954 | Jandus | 74/540 UX |
| 3,519,155 | 7/1970 | Jefferson et al. | 214/764 |

*Primary Examiner*—William L. Freeh
*Assistant Examiner*—Michael Koczo, Jr.
*Attorney, Agent, or Firm*—Phillips, Moore, Weissenberger, Lempio & Strabala

[57] ABSTRACT

A control module comprises a bracket assembly adapted for attachment to a support structure of a construction vehicle. A control lever is pivotally mounted on the bracket assembly along with a bellcrank having a roller mounted on a first arm thereof. The roller is adapted to selectively engage at least one notch formed on the control lever to form a detent mechanism and is biased in that direction by a tension coil spring connected between the bracket assembly and a second arm of the bellcrank. A control rod is reciprocally mounted in the bracket assembly and has its first end pivotally connected to the control lever and is adapted to have its second end connected to a self-centering valve spool of a directional control valve. A lost-motion link is interconnected between the first arm of the bellcrank and a solenoid plunger of a kickout mechanism to selectively override the solenoid to release the detent mechanism.

10 Claims, 1 Drawing Figure

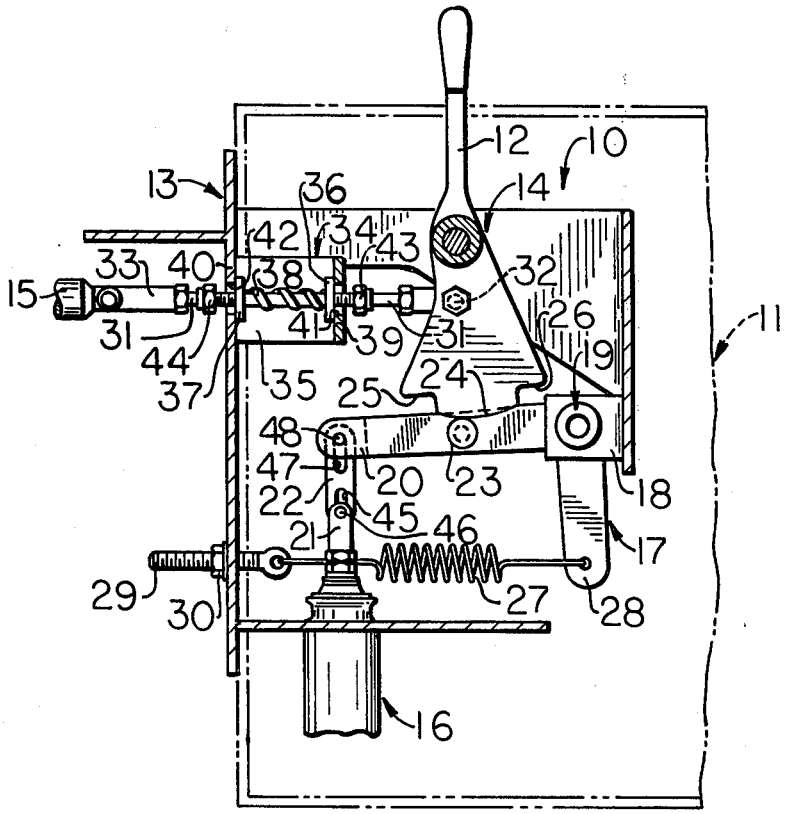
12
10
13
36
14
42
34
43
33
40
38
32
15
26
11
31
41
39
31
19
44
37
35
25
24
48
47
20
23
18
22
45
46
21
17
29
30
27
28
16

CONTROL MODULE WITH OVERRIDE MECHANISM

BACKGROUND OF THE INVENTION

The pilot-operated hydraulic control group for selectively moving a loader bucket on a wheel loader in various positions of operation thereon comprises a directional control valve adapted to be actuated by a control lever. A detent mechanism is normally associated with the control lever to hold it in selected conditions of operation (e.g., rack-back, raise, float) to release the operator's hand for actuation of other control levers. The detent mechanism is further operatively associated with a kick-out mechanism, which may include a solenoid, for releasing the detent mechanism in response to raising or lowering of the loader bucket.

Upon such release of the detent mechanism, a centering spring, normally enclosed within the valve body of the directional control valve, will function to return the valve spool thereof and the control lever to neutral or hold conditions of operation. Should the solenoid of the kick-out mechanism become ineffective, the solenoid will normally require dismantling for repair purposes. Examples of such a control group are disclosed in U.S. Pat. No. 3,519,155, and U.S. Pat. Application Ser. No. 674,785, filed on Apr. 8, 1976 by Stanley B. Adams et al for "Pre-Adjusted Control Module For Construction Vehicles", now U.S. Pat. No. 4,074,690, both assigned to the assignee of this application.

SUMMARY OF THIS INVENTION

An object of this invention is to provide a noncomplex and compact control module of the above type, including lost-motion means associated with a control lever thereof for selectively overriding a kick-out mechanism. The control module comprises a bracket assembly adapted for attachment on the vehicle, having a control lever pivotally mounted thereon. Releasable holding means functions to selectively hold the control lever in at least one pivoted position thereof on the bracket assembly.

A control rod is mounted on the bracket assembly and has a first end thereof connected to the control lever and is adapted to have a second end thereof connected to the valve spool of a self-centering directional control valve. The lost-motion means is interconnected between the kick-out means and the holding means for selectively releasing said holding means to override the kick-out means to permit the control lever to actuate the control rod independent of the kick-out means.

BRIEF DESCRIPTION OF THE DRAWING

Other objects of this invention will become apparent from the following description and accompanying drawing which is a partially sectioned side elevational view of a control module of this invention adapted to be mounted on a support structure of a construction vehicle.

DETAILED DESCRIPTION

The drawing illustrates a control module 10 of this invention detachably mounted on a support structure 11 of a construction vehicle, the support structure being shown in phantom lines. The control module comprises a pair of control levers 12 (one shown) each pivotally mounted on a common bracket assembly 13 by a pivot means 14 for selectively actuating a spool 15 of a self-centering directional control or pilot valve (not shown). The valve may be of the type adapted to selectively communicate pressurized fluid to a manifold block and/or to exhaust fluid therefrom in a conventional manner.

For example, the control module of this invention is particularly adapted for use on a wheel loader for selectively moving the lift arms and loader bucket thereof to various positions of operation by suitably arranged lift cylinders and a tilt linkage (not shown). In such an application, a standard solenoid 16 may be suitably slaved to and form part of a standard bucket kick-out means responsive to movement of a component of the loader bucket assembly to release control lever 12 to permit automatic return thereof to a preselected position which, in turn, places directional control valve spool 15 in a neutral or hold condition of operation. As disclosed in above mentioned U.S. application Ser. No. 674,785, now U.S. Pat. No. 4,074,690 the control module is adapted to be pre-adjusted and thereafter installed on support structure 11 of the vehicle in contrast to conventional control groups which are adjusted in situ on the vehicle.

A releasable holding means for selectively locking each control lever 12 in one of two pivoted or detent positions on bracket assembly 13 comprises a bellcrank 17 pivotally mounted on a U-shaped bracket 18, secured interiorly of bracket assembly 13, by a pivot means 19. The bellcrank has a first arm 20 extending within the confines of the bracket assembly to have its outer end pivotally connected to a plunger 21 of solenoid 15 by a lost-motion link 22, hereinafter more fully described. A follower or roller 23 is rotatably mounted on arm 20, between pivot means 19 and link 22, to normally engage an arcuate cam 24 formed on a lower end of control lever 12.

A pair of notches 25 and 26 are also formed on the lower end of the control lever and are disposed on either side of cam 24 to selectively receive roller 23 therein upon manipulation of the control lever. A tension coil spring 27 has a first end thereof anchored to a downwardly extending second arm 28 of the bellcrank and a second end thereof anchored to bracket assembly 13. The latter anchor preferably comprises an eye bolt 29 threadably mounted in a nut 30 secured on an interior plate of the bracket assembly to provide adjustment means for pre-adjusting the tension on spring 27 whereby roller 23 is biased against control lever 12 under a predetermined force.

An axially adjustable control lever is dictated by engagement of roller 23 with one of the two notches 25 or 26. When control lever 12 is released from its detent positions, it will move automatically to its illustrated position wherein roller 23 engages cam 24 and self-centering valve spool 15 will thus be placed in a hold, neutral or other preselected condition of valve operation.

The sensing means comprises a bracket 35 integrally secured within the confines of bracket assembly 13 to expose the same for pre-adjusting and servicing purposes. The sensing means further comprises a pair of axially spaced annular washers 36 and 37 reciprocally mounted on control rod 31. A compression coil or bumper spring 38 is mounted on the control rod to normally expand washers 36 and 37 into abutment with an end plate 39 of bracket 35 and a mounting plate 40 of bracket assembly 13, respectively.

A pair of axially aligned circular openings 41 and 42 are formed through plates 39 and 40, respectively, to reciprocally mount control rod 31 therethrough. The outer diameters of such openings are less than the outer diameters of washers 36 and 37 to prevent the washers from moving therethrough. A pair of nuts 43 and 44 are threadably mounted on the control rod to provide axially spaced stop means disposed on the outboard sides of and axially spaced from the washers for alternately engaging and moving the washers against the counteracting force of spring 38 upon reciprocation of the control rod by control lever 12 in either direction. The outer dimensions of the nuts are less than the inside diameters of the openings to permit them to reciprocate therethrough to effect such compression of the coil spring.

Subsequent to pre-adjustment of the control module to coordinate the movements and relative positions of control lever 12, bellcrank 17, solenoid plunger 21 and valve spool 15, the control module is suitably attached on support structure 11 of the vehicle. Since the housing of the directional control valve may be suitably premounted on bracket assembly 13 along with the other components of the control module, the control module need undergo little, if any, further adjustment to place it in condition for operation. It should be further noted that should any servicing be required in the area of the control lever, sensing means 34, bellcrank or solenoid, that the same may be accomplished expeditiously due to the substantially exposed and serviceable positions thereof on the vehicle.

This invention is primarily drawn to the utilization of a lost-motion means for the above described control module for permitting the operator to override solenoid 16 to selectively release roller 23 from one of the two detents 27 and 28. The lost motion means comprises link 22 having a first lost-motion slot 45 formed therethrough, pivotally mounting the link on solenoid plunger 21 by a pin 46. A second lost-motion slot 47 is formed through the link and pivotally mounts the link on first arm 20 of bellcrank 17 by a pin 48.

The lost-motion means is thus interconnected between solenoid 16 of the kick-out means and bellcrank 17 of the holding means for selectively releasing the holding means to override the kick-out means. The operator is thus free to actuate control rod 31 and spool 15, independent of the kick-out means and should solenoid 16 fail in operation. Lost-motion link 22 will also allow limited lateral freedom of motion, as between the yoke of solenoid plunger 21 and the attached clevis of bellcrank arm 20.

The embodiments of the invention in which an exclusive property or privilege is claimed are defined as follows:

1. A control module adapted for mounting on a vehicle comprising a bracket assembly adapted for attachment to a support structure of said vehicle, a control lever, pivot means pivotally mounting said control lever on said bracket assembly, releasable holding means for selectively holding said control lever in at least one pivoted position thereof on said bracket assembly, a control valve having a valve spool reciprocally mounted therein, a control rod movably mounted on said bracket assembly and having a first end thereof connected to said control lever and having a second end thereof connected to the reciprocal valve spool of said control valve, kick-out means connected to said holding means for releasing it from said pivoted position, lost-motion means interconnected between said kick-out means and said holding means for selectively permitting release of said holding means while simultaneously overrriding said kick-out means upon movement of said control lever to permit said control lever to actuate said control rod, independent of said kick-out means, and a support structure and wherein said bracket assembly is detachably mounted on said support structure.

2. The control module of claim 1 wherein said releasable holding means comprises a bellcrank pivotally mounted on said bracket assembly, follower means mounted on said bellcrank and notch means formed on said control lever and adapted to selectively engage said follower for holding said control lever in said pivoted position.

3. The control module of claim 2 wherein said bellcrank comprises a first arm having said follower means mounted thereon and a second arm and further comprising tension spring means interconnected between the second arm of said bellcrank and said bracket assembly for pivoting said bellcrank to urge said follower into said notch means.

4. The control module of claim 3 further comprising an arcuate cam formed on a lower end of said control lever and wherein said notch means comprises a pair of notches formed on the lower end of said control lever and disposed on either side of said arcuate cam.

5. The control module of claim 3 further comprising means mounting an end of said tension spring means on said bracket assembly for selectively adjusting the tension thereof.

6. The control module of claim 1 wherein said kick-out means comprises a solenoid mounted on said bracket assembly and a plunger reciprocally mounted in said solenoid and wherein said lost-motion means is interconnected between said holding means and said plunger.

7. The control module of claim 1 wherein said lost-motion means comprises a link pivotally interconnected between said holding means and said kick-out means.

8. The control module of claim 7 wherein said link has a pair of lost-motion slots formed in opposite ends thereof and wherein said slots pivotally mount said link to said holding means and said kick-out means.

9. A control module adapted for mounting on a vehicle comprising a bracket assembly adapted for attachment to a support structure of said vehicle, a control lever, pivot means pivotally mounting said control lever on said bracket assembly, releasable holding means for selectively holding said control lever in at least one pivoted position thereof on said bracket assembly, a control rod movably mounted on said bracket assembly and having a first end thereof connected to said control lever and adapted to have a second end thereof connected to a control valve, kick-out means connected to said holding means for releasing it from said pivoted position, lost-motion means interconnected between said kick-out means and said holding means for selectively permitting release of said holding means while simultaneously overriding said kick-out means upon movement of said control lever to permit said control lever to actuate said control rod, independent of said kick-out means, and a reciprocal valve spool and wherein said control rod is connected to said valve spool to reciprocate the same upon pivoting of said control lever.

10. A control module adapted for mounting on a vehicle comprising a bracket assembly adapted for attachment to a support structure of said vehicle, a control lever, pivot means pivotally mounting said control lever on said bracket assembly, releasable holding means for selectively holding said control lever in at least one pivoted position thereof on said bracket assembly, said releasable holding means comprising a bellcrank pivotally mounted on said bracket assembly, follower means mounted on said bellcrank and notch means formed on said control lever and adapted to selectively engage said follower for holding said control lever in said pivoted position, said bellcrank comprising a first arm having said follower means mounted thereon and a second arm and further comprising tension spring means interconnected between the second arm of said bellcrank and said bracket assembly for pivoting said bellcrank to urge said follower into said notch means, a control rod movably mounted on said bracket assembly and having a first end thereof connected to said control lever and adapted to have a second end thereof connected to a control valve, kick-out means connected to said holding means for releasing it from said pivoted position, and lost-motion means interconnected between said kick-out means and said holding means for selectively permitting release of said holding means while simultaneously overriding said kick-out means upon movement of said control lever to permit said control lever to actuate said control rod, independent of said kick-out means.

* * * * *